US006330786B1

(12) United States Patent
Settle

(10) Patent No.: US 6,330,786 B1
(45) Date of Patent: Dec. 18, 2001

(54) BUFFALO HAIR YARN AND FABRIC AND METHOD OF MAKING BUFFALO HAIR YARN AND FABRIC

(75) Inventor: Sheri Stotz Settle, Rapid City, SD (US)

(73) Assignee: Great Plains Buffalo Products, Inc., Rapid City, SD (US)

( * ) Notice: Subject to any disclaimer, the term of this patent is extended or adjusted under 35 U.S.C. 154(b) by 0 days.

(21) Appl. No.: 09/393,978

(22) Filed: Sep. 10, 1999

(51) Int. Cl.[7] ..... D02G 3/02; D01B 3/00

(52) U.S. Cl. ..... 57/200; 57/28; 57/252; 19/2; 19/66 R

(58) Field of Search ..... 57/200, 252, 256, 57/28, 4; 428/16; 8/405; 19/2, 66 R

(56) References Cited

U.S. PATENT DOCUMENTS

| | | | | |
|---|---|---|---|---|
| 235,519 | * | 12/1880 | Finn et al. . | |
| 1,147,720 | * | 7/1915 | Harden . | |
| 1,986,970 | * | 1/1935 | Haughey | 57/252 |
| 1,987,632 | * | 1/1935 | Nutter et al. | 57/210 |
| 2,547,060 | * | 4/1951 | Tillisch . | |
| 2,950,591 | * | 8/1960 | Mandukich | 57/315 |
| 3,156,952 | * | 11/1964 | Walker . | |
| 4,048,371 | * | 9/1977 | Brumlik | 428/375 |
| 4,343,619 | * | 8/1982 | Kazama et al. | 8/139 |
| 4,362,173 | * | 12/1982 | Blinman | 132/119.1 |
| 4,751,117 | * | 6/1988 | Goodfellow | 428/16 |
| 5,038,447 | * | 8/1991 | Schmidt et al. | 28/112 |
| 5,155,989 | * | 10/1992 | Frey et al. | 57/327 |
| 5,176,716 | * | 1/1993 | Lorenz et al. | 8/405 |

FOREIGN PATENT DOCUMENTS

| | | | | |
|---|---|---|---|---|
| 354615 | * | 8/2000 | (GB) | 57/252 |
| 25431 | * | 2/1982 | (JP) | 57/256 |
| WO-8911557-A1 | * | 11/1989 | (WO) . | |

* cited by examiner

*Primary Examiner*—Rodney M. Lindsey
(74) *Attorney, Agent, or Firm*—Dorr, Carson, Sloan & Birney, P.C.

(57) ABSTRACT

A yarn comprising buffalo hair and wool is commercially spun, in which the yarn has between about 5% to about 95% buffalo hair and between about 95% to about 5% fiber, and particularly has about 20% buffalo hair and about 80% fiber. The yarn is used to make fabric that can be used to make clothing, blankets, and other goods.

19 Claims, 3 Drawing Sheets

BUFFALO HAIR YARN AND FABRIC AND METHOD OF MAKING BUFFALO HAIR YARN AND FABRIC

BACKGROUND OF THE INVENTION

Field of the Invention

The present invention relates to yarn and fabric made from said yarn, and more particularly, to yarn and fabric comprising a buffalo hair-fiber blend, and a method of making yarn and fabric comprising a buffalo hair-fiber blend.

Statement of the Problem

The buffalo, or American bison, is a magnificent animal found on the plains of North America. The buffalo is related to domestic cattle and other bovines, although generally larger, and has a heavy coat of hair, called the cape, extending over its front portions. The cape comprises two types of hair, coarse guard hairs and fine, soft down hairs.

There is a historical significance and present Western/Plains mystique about the buffalo, a national and spiritual symbol. Native American peoples found the buffalo to be essential to their existence. To honor the buffalo, they used every part of the animal. It was a source of food, and its hide provided clothing and shelter. The hair of the buffalo was used to stuff pillows and moccasins and was plaited to make ropes. The Plains Indians who had access to the buffalo were nomadic people who did not spin yarns or weave cloth.

When European people came to North America, they also found many uses for the buffalo. The explorers Lewis and Clark brought back hides and attempted to find some way to utilize the buffalo hair apart from the heavy leather hide, but the textile experts rejected the idea of weaving buffalo hair into textiles as unfeasible. After the near extinction of the buffalo, buffalo hair simply was not available.

In the last ten years, ranchers have begun to raise buffalo commercially. This enabled shed buffalo hair to be gathered, and the shed buffalo hair has been hand spun and hand woven. One hand spinner uses only the fine down hairs, and hand knits the resulting yarn into wearable items. Others use both the guard hairs and the down. The latter type of yarn can be woven into fabric on a hand loom.

The handspun yarn provides only very small amounts of product, and at a prohibitive cost of more than $100 per pound of yarn. Because buffalo hair is dark brown, the handspun yarn is also dark brown, and does not dye well except to darker shades of brown or black.

Given the mystique associated with the buffalo and the Old West, a demand exists for commercial, cost-effective methods to provide products made with buffalo hair, that is, with yarn and fabric comprising buffalo hair, and to provide buffalo hair yarn and fabric in colors other than dreary dark brown. The handspun method cannot produce the quantities of yarn necessary to fulfill this need.

Solution to the Problem

The present invention discloses a buffalo hair yarn that is preferably blended with other fibers during the spinning process. A method of making a buffalo hair-fiber yarn with conventional commercial machinery is described. The commercially spun buffalo hair-fiber yarn can be dyed to desired colors. Once spun, the buffalo hair-fiber yarn can be used to provide a plurality of fabric types.

Summary of the Invention

This invention provides a commercially spun yarn comprising buffalo hair and, preferably, another fiber, for example, sheep wool. The commercially spun buffalo hair-fiber yarn is dyeable. The commercially spun buffalo hair-fiber yarn is used to make fabric. "Fabric" is defined in the present specification as any spun, knitted, woven, pressed, nonwoven, or otherwise formed material made from buffalo hair alone or from buffalo hair blended with natural or synthetic fibers, including fabric, cloth, knitted goods, drapery material, upholstery material, velour, velvet, velveteen, corduroy, rugs, carpet, and the like.

In the method of the present invention, buffalo hair is provided by shaving the cape from buffalo hides. The buffalo hair is then processed with conventional commercial machinery to make yarn. First, the buffalo hair is raked with a conventional commercial raking machine and dried. If desired, the buffalo hair is then blended with another fiber. The other fiber can be of natural or man-made origin. The amount of fiber blended with the buffalo hair is between about 5% and about 95% by weight. In a highly preferred embodiment, the fiber used for blending is sheep wool.

Once blended, the buffalo hair-fiber blend can be dyed if desired. After dyeing, the buffalo hair-fiber blend is carded with a conventional commercial carding machine. The carded buffalo hair-fiber blend is then spun with a conventional commercial spinning frame to make yarn comprising the buffalo hair and fiber.

It is an object of the present invention to use conventional commercial machinery to spin yarn comprising buffalo hair. It is another object of the present invention to use commercially spun buffalo hair yarn to make fabric.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
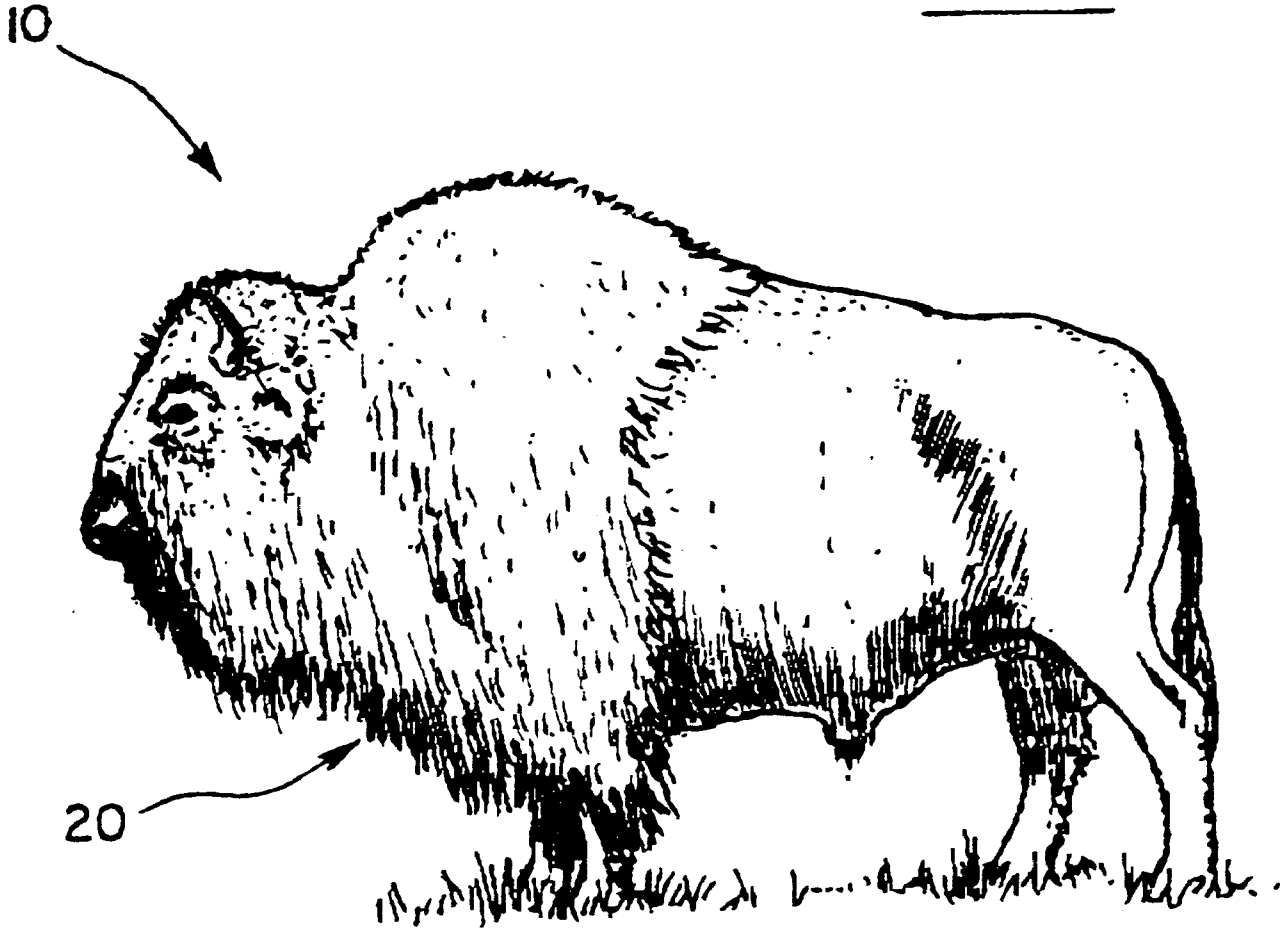
FIG. 1 is a side view of a buffalo showing the cape.
Figure 2:
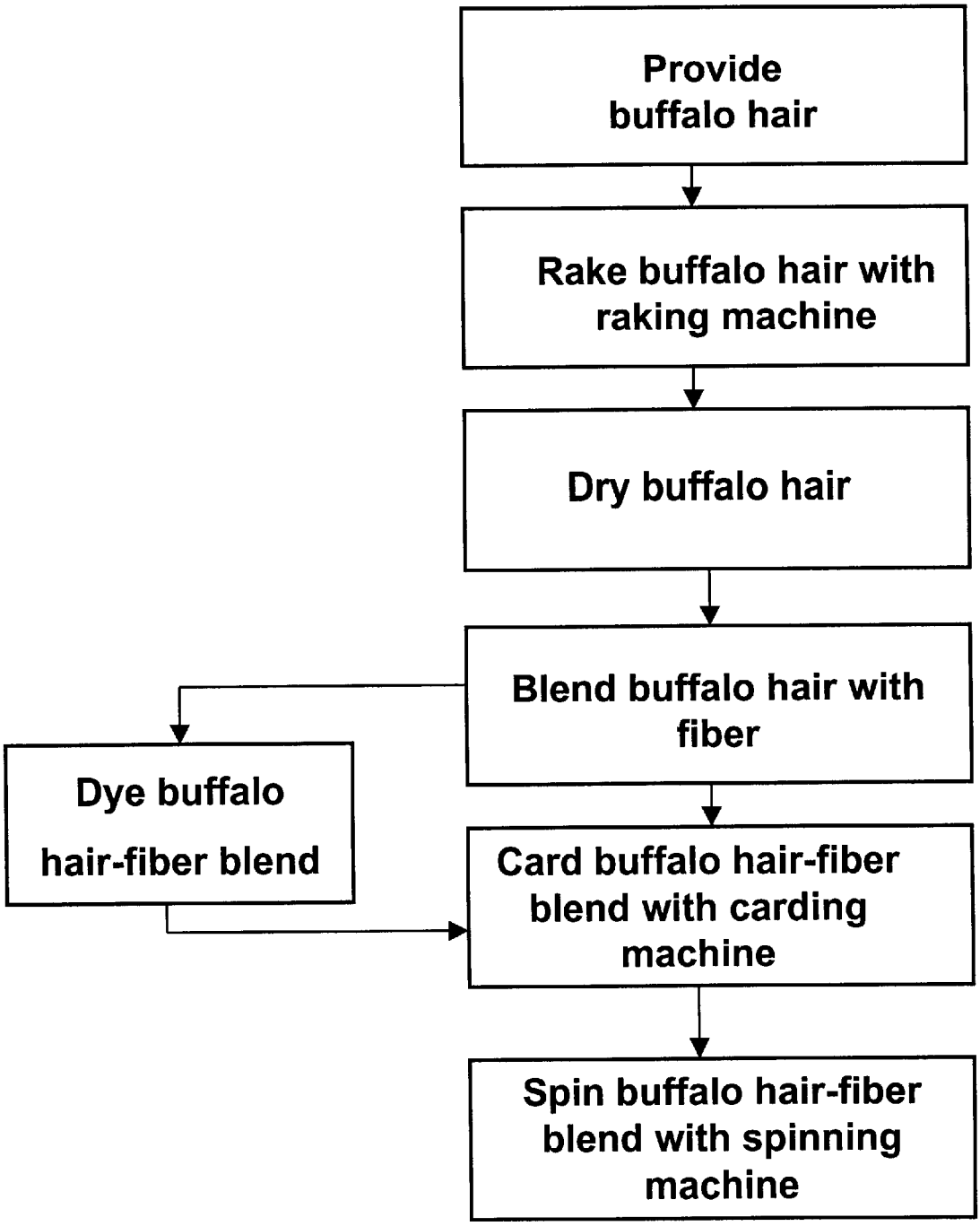
FIGS. 2 and 3 are flowcharts of the disclosed method of making yarn with buffalo hair.
Figure 3:
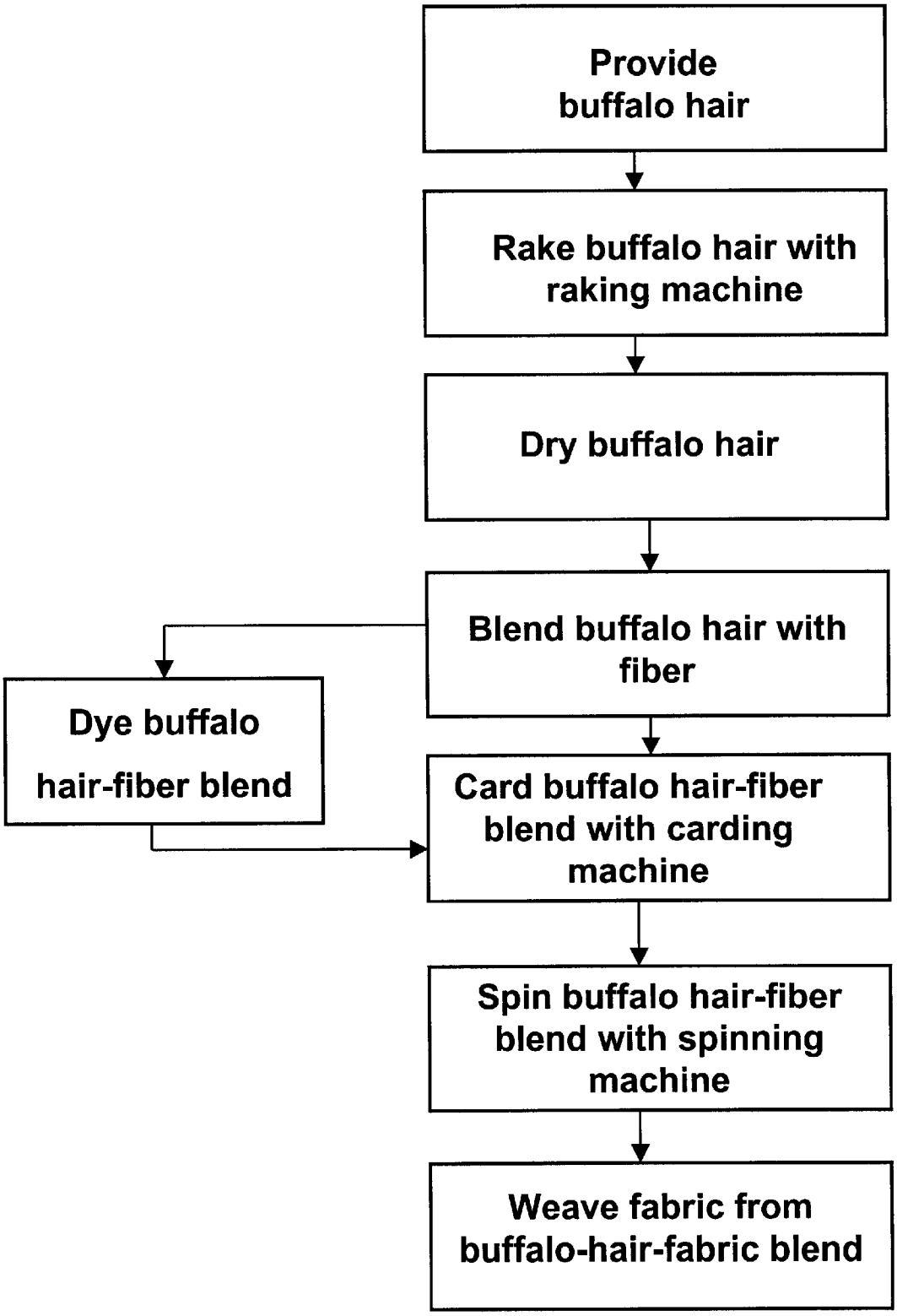

Referring to FIG. 1, it can be seen that a buffalo 10 is a large bovine animal that grows a cape 20 of hair in the region of its forequarters. The cape 20 consists of coarse guard hairs and fine down hairs. The guard hairs are hollow and range from 21 to 110 microns in diameter. The fine down hairs are solid with a diameter of 12 to 29 microns and have scales. Both types of hair vary less than 1 micron in diameter from root to tip. Throughout this specification, the term "buffalo hair" will refer to the mixture of guard hairs and down hairs found in the buffalo cape 20. However, it is to be understood that the present invention can be practiced using only guard hairs or using only down hairs, or using any combination thereof.

It is important to the present invention that the entire method for making yarn comprising buffalo hair is performed on conventional commercial machinery. By using commercial machinery, mass production of commercially spun buffalo hair yarn is obtainable with a reduction of handling and processing over previous methods involving hand work, which are cost prohibitive.

The method for making yarn comprising buffalo hair using commercial machinery was only feasible after applicant discovered that buffalo hair can be blended with other fibers as described hereinbelow. This mitigated the fear that the coarse buffalo hair would damage the commercial machinery. It also enabled the yarn to be dyed with any color desired.

The following steps are the specific acts that implement the method of the present invention.

In order to make commercially spun yarn made from buffalo hair, it is first necessary to provide the buffalo hair. Buffalo hair is provided by shaving the cape 20 from hides obtained from slaughtered animals. Naturally, the entire buffalo 10 is covered with hair. However, for use in the present invention, the buffalo hair must be at least 1½ inches long. The cape 20 is the only area that provides sufficient buffalo hair having this minimum length, and only at certain times of year.

Once the buffalo hair is provided, it is then raked to clean it. The raking is done by conventional methods and with conventional commercial raking machines that are known to those skilled in the art. Raking involves first placing the buffalo hair from the cape 20 in water and then running the buffalo hair through the raking machine. A significant advantage of using buffalo hair to make yarn is that the buffalo hair does not have to be scoured before raking. Contrary to all previous attempts to use buffalo hair, it has been discovered in the present invention that buffalo hair is not heavily coated with oil or lanolin, as is found in, for example, sheep wool and other animal hair. Thus, the buffalo hair does not have to be scoured before it is raked.

After raking, the buffalo hair is removed from the raking machine and dried. Once dry, the buffalo hair is processed into yarn by using commercial machinery as described hereinbelow.

In a preferred embodiment, however, the raked and dried buffalo hair is first blended by machine with one or more other fibers if desired. "Fiber" is any natural or synthetic fiber, in continuous filament or staple form, which may be spun, knitted, woven, pressed or otherwise formed into a textile material or fabric, including silks, cottons, wool, leather, fur, alpaca, llama, camel, cashmere, angora, vicuna, guanaco, other animal hair, kapok, linen, hemp, flax, jute, manila, alfa, coconut, broom, kenaf, ramie, sisal, polyesters, acetates, triacetates, rayon, rayon-acetates, cellulose, polypropylene-cellulose, alginates, cupro (regenerated cellulose), modal, regenerated protein fiber, polyacryl, polychloride, fluorofiber, modacryl, polyacrylonitrile, polyamide (including nylon), polyethylene, polypropylene, polyurea, polyurethane, vinylal, trivinyl, elastodiens, elasthane, and mixtures of these natural and synthetic fibers, among others. Any type of fiber or combination of fibers can be used to blend with the buffalo hair, including but not limited to those defined above.

The type of fiber used to blend with the buffalo hair depends on the characteristics desired in finished yarn or woven product. For example, a fiber is blended with the buffalo hair so that the natural color of the fiber lightens the dark brown natural color of the buffalo hair. In another example, the blend can be dyed if a color other than the natural color of the fiber or of the buffalo hair is desired. Blending can also give the final product other desired characteristics, for example, durability or warmth. Another reason for blending a fiber with the buffalo hair is to provide yarn with a coarseness of between about 1% and about 9%.

Preferably between about 5% and about 95% by weight of the fiber of choice is blended with the buffalo hair to obtain the desired fabric characteristics. The amount of buffalo hair in the blend thus is between about 5% and about 95% by weight.

In a highly preferred embodiment, sheep wool is blended with the buffalo hair. The amount of sheep wool preferably ranges between about 5% and about 95% by weight. Sheep wool is preferred because it is readily available, inexpensive, provides durablility and warmth, and can be dyed easily. In a preferred embodiment, at least 70% sheep wool is blended with at most 30% buffalo hair in order for the resulting blend to be dyeable. In a more preferred embodiment, about 80% sheep wool is blended with about 20% buffalo hair.

After the buffalo hair is blended with the other fiber, the blend of buffalo hair and fiber is dyed if desired. For dyeing, a blend of less than about 30% buffalo hair is preferable.

After dyeing, or after blending if no dyeing is performed, the buffalo hair-fiber blend is carded by conventional methods known to those skilled in the art using a conventional commercial carding machine. The carding process produces a long, untwisted or very loosely twisted strand called a roving. The buffalo hair-fiber blend roving is then spun on a conventional commercial spinning frame to produce a commercially spun yarn comprising a buffalo hair-fiber blend.

It is important to the present invention that all the steps set forth above are done with conventional commercial machinery and not by hand. It had not previously been thought possible, and had in fact been rejected by those skilled in the art, to use conventional commercial machinery to prepare yarn containing buffalo hair, and it is applicant's discovery that such conventional commercial machinery can be used with buffalo hair. The use of commercial machinery lowers the cost of the buffalo hair-fiber yarn of the present invention from $100 per pound for handspun to $4.35 per pound if undyed and to $6.60 per pound if dyed. The use of commercial machinery also provides sufficient quantities of fabric to make it commercially feasible to market products.

Once the commercially spun buffalo hair-fiber yarn is produced by the method described above, it is used to make fabric by any conventional method. "Fabric" is defined herein as any spun, knitted, woven, pressed, non-woven, or otherwise formed material made from buffalo hair alone or from buffalo hair blended with natural or synthetic fibers as described hereinabove, including fabric, cloth, textiles, knitted goods, drapery material, upholstery material, velour, velvet, velveteen, corduroy, rugs, carpet and the like. Such fabrics containing buffalo hair are then made into clothing, blankets, upholstery, furniture, hats, and other goods.

Thus, a yarn comprising a buffalo hair-fiber blend has been provided. The buffalo hair-fiber yarn is made by using commercially available machines and methods. This provides a great savings over the cost of handspun yarn, will provide quantities allowing for commercial production of products, and thus will enable commercialization of the product.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternate embodiments to the extent permitted by the prior art.

I claim:

1. A yarn comprising buffalo hair having a solid core and fiber, wherein said yarn comprises between about 5% to about 95% buffalo hair and between about 5% to about 95% fiber.

2. The yarn of claim 1 wherein said fiber is selected from the group consisting of silk, cotton, wool, leather, fir, alpaca, llama, camel, cashmere, angora, vicuna, guanaco, animal hair, kapok, linen, hemp, flax, jute, manila, alfa, coconut, broom, kenaf, ramie, sisal, polyester, acetate, triacetate, rayon, rayon-acetate, cellulose, polypropylene-cellulose, alginates, cupro, modal, regenerated protein fiber, polyacryl, polychloride, fluorofiber, modacryl, polyacrylonitrile, polyamide, polyethylene, polypropylene, polyurea, polyurethane, vinylal, trivinyl, elastodien, and elasthane.

3. The yarn of claim 1 wherein said yarn has a coarseness of between about 1% and about 9%.

4. The yarn of claim 1 wherein said fiber is sheep wool.

5. The yarn of claim 4 comprising about 20% buffalo hair and about 80% sheep wool.

6. A yarn comprising about 20% buffalo hair having a solid core and about 80% sheep wool.

7. A method of making yarn with buffalo hair comprising the steps of:

providing buffalo hair;

raking said buffalo hair with a commercial raking machine;

drying said buffalo hair;

blending said buffalo hair with a fiber to provide a buffalo hair-fiber blend;

carding said buffalo hair-fiber blend with a commercial carding machine; and spinning said buffalo hair-fiber blend with a commercial spinning framer to provide yarn.

8. The method of claim 7 further comprising the step of dyeing said buffalo hair-fiber blend before carding.

9. The method of claim 7 wherein said fiber is selected from the group consisting of silk, cotton, wool, leather, fur, alpaca, llama, camel, cashmere, angora, vicuna, guanaco, animal hair, kapok, linen, hemp, flax, jute, manila, alfa, coconut, broom, kenaf, ramie, sisal, polyester, acetate, triacetate, rayon, rayon-acetate, cellulose, polypropylene-cellulose, alginates, cupro, modal, regenerated protein fiber, polyacryl, polychloride, fluorofiber, modacryl, polyacrylonitrile, polyamide, polyethylene, polypropylene, polyurea, polyurethane, vinylal, trivinyl, elastodien, and elasthane.

10. The method of claim 9 wherein said yarn comprises between about 5% to about 95% buffalo hair and between about 95% to about 5% fiber.

11. The method of claim 10 wherein said fiber is sheep wool, and wherein said yarn comprises about 20% buffalo hair and about 80% sheep wool.

12. A method of making fabric with buffalo hair comprising the steps of:

providing buffalo hair;

raking said buffalo hair with a commercial raking machine;

drying said buffalo hair;

blending said buffalo hair with a fiber to provide a buffalo hair-fiber blend;

carding said buffalo hair-fiber blend with a commercial carding machine;

spinning said combined buffalo hair and fiber into yarn with a commercial spinning framer to provide commercially spun yarn; and using said commercially spun yarn to make said fabric.

13. The method of claim 12 wherein said fiber is selected from the group consisting of silk, cotton, wool, leather, fur, alpaca, llama, camel, cashmere, angora, vicuna, guanaco, animal hair, kapok, linen, hemp, flax, jute, manila, alfa, coconut, broom, kenaf, ramie, sisal, polyester, acetate, triacetate, rayon, rayon-acetate, cellulose, polypropylene-cellulose, alginates, cupro, modal, regenerated protein fiber, polyacryl, polychloride, fluorofiber, modacryl, polyacrylonitrile, polyamide, polyethylene, polypropylene, polyurea, polyurethane, vinylal, trivinyl, elastodien, and elasthane.

14. The method of claim 13 wherein said yarn comprises between about 5% to about 95% buffalo hair and between about 95% to about 5% fiber.

15. The method of claim 13 wherein said fiber is sheep wool, and wherein said yarn comprises about 20% buffalo hair and about 80% sheep wool.

16. A method of making fabric with buffalo hair comprising the steps of:

providing buffalo hair;

raking said buffalo hair with a commercial raking machine;

drying said buffalo hair;

blending said buffalo hair with sheep wool to provide a buffalo hair-sheep wool blend wherein said blend comprises about 20% buffalo hair and about 80% sheep wool;

dyeing said buffalo hair-sheep wool blend; carding said buffalo hair-sheep wool blend with a commercial carding machine;

spinning said buffalo hair-sheep wool blend into yarn with a commercial spinning framer to provide yarn; and using said yarn to make said fabric.

17. A yarn comprising between about 34% and about 95% buffalo hair and between about 5% and about 66% sheep wool.

18. The method of claim 10 wherein said fiber is sheep wool, and said yarn comprises about between about 34% to about 95% buffalo hair and between about 5% to about 66% sheep wool.

19. The method of claim 13 wherein said fiber is sheep wool, and wherein said yarn comprises between about 34% to about 95% buffalo hair and between about 5% to about 66% sheep wool.

* * * * *